United States Patent [19]

Wilson

[11] 4,198,016

[45] Apr. 15, 1980

[54] FLOATING CANARD WITH GEARED TAB

[75] Inventor: Malcolm C. Wilson, Saratoga, Calif.

[73] Assignee: The United States of America as represented by the Secretary of the Navy, Washington, D.C.

[21] Appl. No.: 914,635

[22] Filed: Jun. 12, 1978

[51] Int. Cl.[2] ..... F42B 15/16; F42B 19/01

[52] U.S. Cl. ..... 244/3.21; 114/23

[58] Field of Search ..... 244/3.1, 3.21; 114/23; 102/3

[56] References Cited

U.S. PATENT DOCUMENTS

| | | | |
|---|---|---|---|
| 1,250,178 | 12/1917 | Hover | 114/23 |
| 3,156,436 | 11/1964 | White | 244/3.21 |
| 3,262,655 | 7/1966 | Gillespie, Jr. | 244/3.21 |
| 3,603,532 | 9/1971 | Harms | 244/3.21 |
| 3,776,490 | 12/1973 | Weis | 244/3.21 |

*Primary Examiner*—Verlin R. Pendegrass

*Attorney, Agent, or Firm*—R. S. Sciascia; Charles D. B. Curry; Francis I. Gray

[57] ABSTRACT

A floating canard with geared tab to stabilize a missile as soon as the missile nose exits the launch tube when the center of pressure is forward of or close to the center of gravity. A freely pivotable canard has a geared tab hinged at its trailing edge. An inextendable link joins a pivot point on the missile body to the tab to provide gearing for the tab. As the canard moves in response to the local angle of attach the tab gearing will drive it further so that the force on the canard will tend to move the missile toward a zero angle of attack.

3 Claims, 6 Drawing Figures

FLOATING CANARD WITH GEARED TAB

BACKGROUND OF THE INVENTION

1. Field of the Invention

The present invention relates to missile nose mounted steering devices, and more particularly to a floating canard with a geared tab.

2. Description of Prior Art

Missiles which are launched prior to rocket motor ignition and subsequent active guidance, such as underwater launched missiles, are inherently unstable due to the fact the center of gravity is behind the center of lateral pressure, causing the nose to tilt. If, additionally, the launch platform is in motion relative to the fluid medium through which the missile is launched, the missile has a tendency to tilt backwards rather than rise vertically resulting in the use of more propellants to compensate for the tilting with concurrent range loss and decreased accuracy. Therefore, it is desirable to eliminate any cross-flow to prevent nose tilt and maintain a vertical position. Prior stabilizing devices such as base fins and flares have been ineffective as they do not take effect as soon as the missile nose exits the launch tube and they only minimize rather than actively counteract the tilting forces.

SUMMARY OF THE INVENTION

Accordingly, the present invention provides a floating canard with a geared tab to provide an active stabilizing effect as soon as the missile nose exits the launch tube when the center of pressure is forwad of or close to the center of gravity. A freely pivotable canard attached to the nose of a missile has a tab hinged at the trailing edge. A link joins a pivot point on the missile body to the tab to provide gearing of the tab so that when the canard moves in response to the local angle of attack the tab gearing will drive it further so that the force on the canard will tend to move the missile nose toward a zero angle of attack relative to the vertical.

Therefore, it is an object of the present invention to provide a stability system for a missile prior to active guidance as soon as the missile is launched.

Another object of the present invention is to provide a means for moving the missile nose toward a zero angle of attack relative to the launch velocity.

Other objects, advantages and novel features of the present invention will be apparent from the following detailed description read in view of the appended claims and attached drawing.

DESCRIPTION OF THE PREFERRED EMBODIMENT

Figure 1:
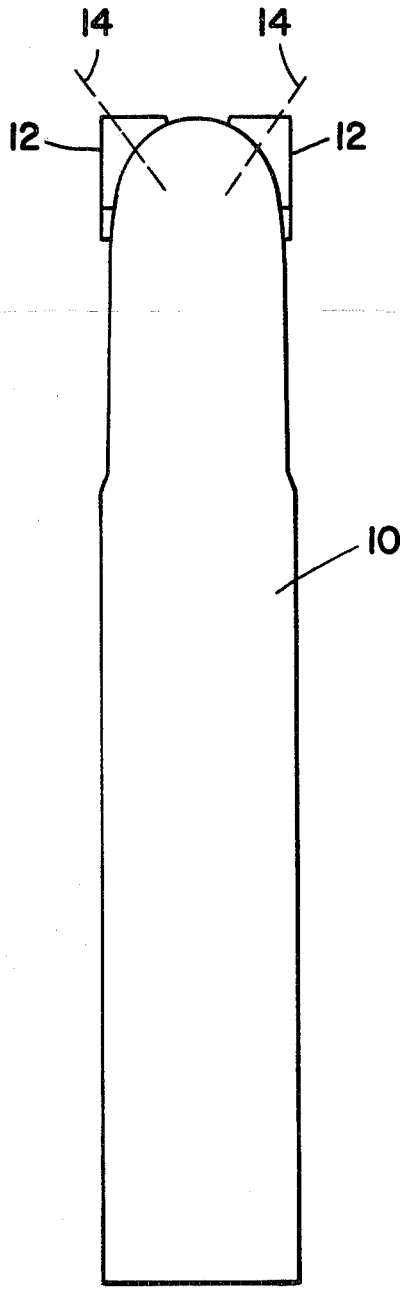
FIG. 1 is a plan view of a missile with a canard.

Referring now to FIG. 1 a missile 10 is shown having two floating canards 12 pivotally attached to the nose. The canards 12 "weather-vane" about pivot axes 14.

Figure 2:
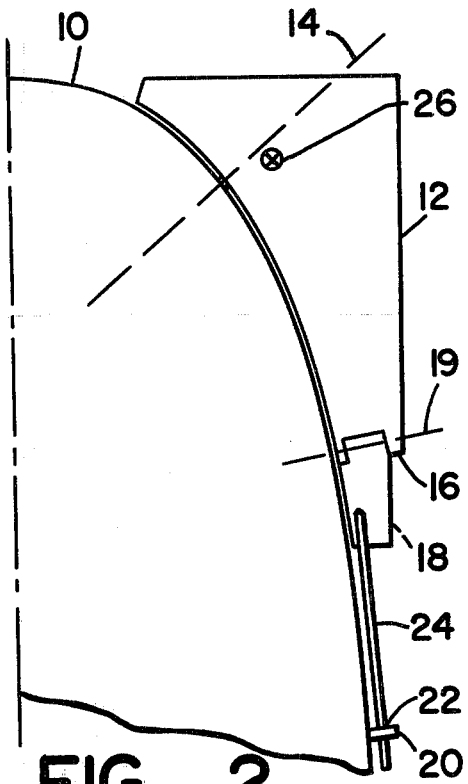
FIG. 2 is a plan view of a missile with a floating canard with geared tab according to the present invention.
Figure 3:
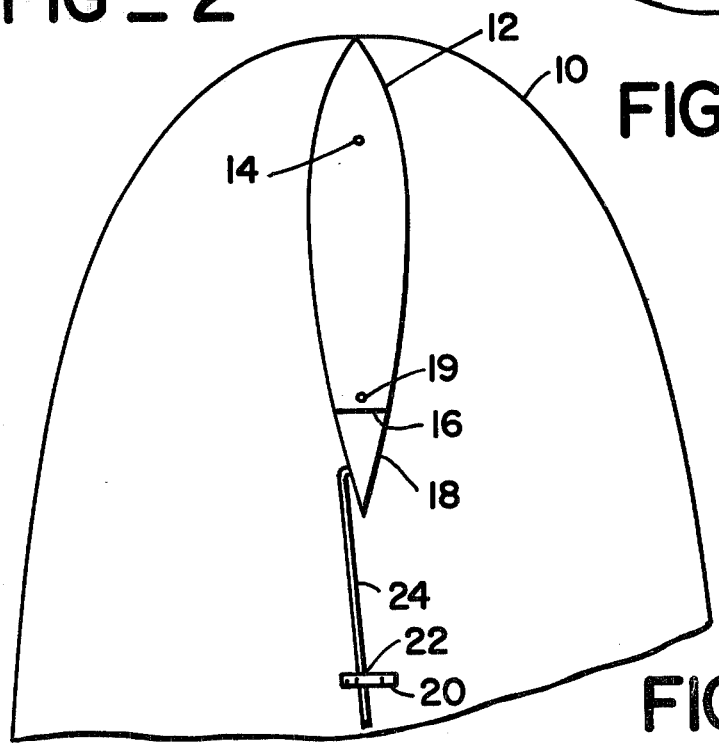
FIG. 3 is another plan view of the floating canard with geared tab of FIG. 2.

FIGS. 2 and 3 show the canard 12 pivotally attached to the missile 10. At the trailing edge 16 is pivotally attached a tab 18 to rotate about pivot axis 19. A stud 20 having a hole 22 is fixedly attached to the missile below the canard 12 and tab 18. An inextendable rod 24 is attached to the tab 18 and extends through the hole 22 of the stud 20. The rod 24 is free to slide within the hole 22, and due to the sloppy fit of the hole has some angular movement. The center of pressure 26 for the canard is located slightly behind the canard pivot axis 14, otherwise the canard, which is sensitive to the center of pressure, will go hard over to stall and will not recover, increasing drag and decreasing effectiveness. The smaller the off-axis distance of the center of pressure, the smaller the tab 18 has to be. Typically, the angular movement of the rod 24 due to the geometric position of the hole 22 of stud 20 is approximately $\pm 20°$, while the canard is free to move over a range of $\pm 30°$–$40°$.

Figure 4A:
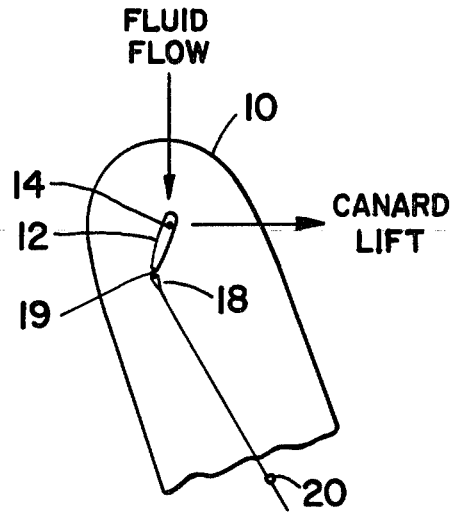
FIG. 4 illustrates the effect of local angle of attack on (a) a floating canard with geared tab and (b) a floating canard without geared tab.
Figure 4B:
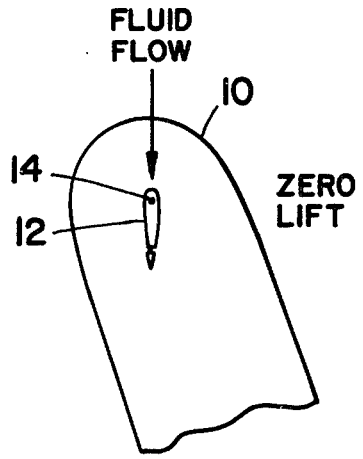

In operation as the missile nose tilts, the canard 12 weathervanes as shown in FIG. 4(*b*). As the canard 12 moves relative to the missile axis the tab 18 is pivoted relative to the axis of the canard due to the action of the rod 24 sliding within stud 20. The effect of the tab deflection is to generate a clockwise moment about the canard pivot 14 so that the canard 12 moves clockwise as shown in FIG. 4(*a*). The canard 12 will rotate to an angle such that the lift generated (acting behind the pivot 14) cancels the moment due to the tab 18. The lift so generated is in a direction to bring the missile back to a zero angle of attack. The result is enchanced stability which allows the launch platform to have a greater speed range at launch, as well as conserving propellants with concomitant range enhancement and improved accuracy.

Figure 5:
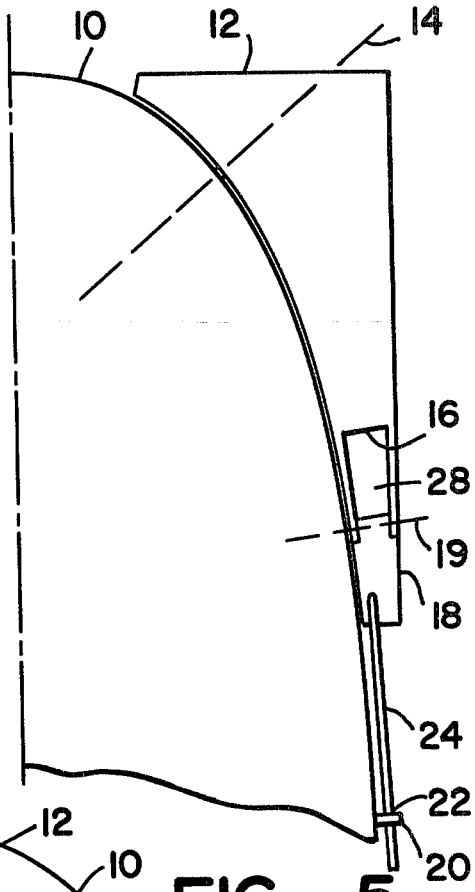
FIG. 5 is a plan view of another embodiment of the floating canard with geared tab according to the present invention.

FIG. 5 shows another embodiment where the tab 18 is spaced apart from the trailing edge of the canard 12, leaving a space 28 between the canard and the tab. The space 28 improves the characteristics of the canard 12 further by providing a bigger moment about the canard pivot axis 14 while leaving the canard trailing edge 16 free so as not to interfere with the fluid flow characteristics over the canard surface.

Thus, the present invention provides a missile stabilization system which provides an active corrective force against nose tilt prior to active guidance as soon as the nose exits the launch tube when the center of pressure is forward of or close to the center of gravity.

What is claimed is:

1. A missile stabilization system comprising:

(a) a canard pivotally connected to the nose of a missile about a pivot axis;

(b) a tab pivotally connected to the trailing edge of said canard;

(c) a stud having a hole therethrough fixedly connected to the body of said missile; and (d) an inextendable rod fixedly connected at one end to said tab and slidingly connected through said hole of said stud at the other end such that when said canard pivots, said rod slides within said hole and causes said tab to pivot with respect to said canard.

2. A missile stabilization system as recited in claim 1 wherein said tab is separated from said canard by a space to increase the moment about said canard pivot axis and to avoid interference with fluid flow characteristics over the canard surface.

3. A missile stabilization system as recited in claims 1 or 2 wherein the center of pressure upon said canard is slightly behind said canard pivot axis.

* * * * *